United States Patent [19]

Petzinger

[11] 4,443,994

[45] Apr. 24, 1984

[54] BRICKLAYER APPARATUS

[76] Inventor: Manfred W. A. Petzinger, Elizabethtown, Ky. 42701

[21] Appl. No.: 186,070

[22] Filed: Sep. 11, 1980

[51] Int. Cl.[3] ..... G01C 15/00

[52] U.S. Cl. ..... 52/749

[58] Field of Search ..... 52/749, 747, 612, 743; 182/63, 193, 197; 425/60, 110; 264/32, 35; 401/25, 22, 48; 33/403, 404, 409, 408

[56] References Cited

U.S. PATENT DOCUMENTS

| | | | |
|---|---|---|---|
| 2,339,892 | 1/1944 | Urschel | 425/110 |
| 2,837,910 | 6/1958 | Steed | 425/60 |
| 3,757,484 | 9/1973 | Williamson | 52/749 |
| 3,782,047 | 1/1974 | Stoltz | 52/749 |

FOREIGN PATENT DOCUMENTS

| | | | |
|---|---|---|---|
| 823555 | 5/1956 | United Kingdom | 33/404 |

*Primary Examiner*—John E. Murtagh

*Attorney, Agent, or Firm*—Darrell E. Hollis

[57] ABSTRACT

A mechanical bricklaying device is disclosed for successively laying a plurality of individual bricks in a given geometrical pattern contained in a horizontal plane. The bricklaying device has a vertical support and a positioning member for positioning a brick in the horizontal plane at a given distance from the vertical support. The positioning member includes a brick guide and a connecting arm connected at one end with the brick guide for supporting the guide in the horizontal plane. The other end of the connecting arm of the positioning member is connected for movement relative to the vertical support, whereby a horizontal layer of successive bricks may be formed having a desired geometrical configuration. In one embodiment, the bricklaying device is adapted to form a layer of bricks having a linear configuration and in a second embodiment, the device is adapted to form a layer of bricks having a curved configuration. Furthermore, the positioning member is vertically adjustable relative to the vertical support, whereby a plurality of stacked horizontal layers of bricks may be formed into a wall.

2 Claims, 8 Drawing Figures

520
524
528
524
524
522
522
524
522
522
532
530
528
510a
510b
510c
512
510
510g
524
528
528
526
526
524
524
524
526
526

BRICKLAYER APPARATUS

BRIEF DESCRIPTION OF THE PRIOR ART

Various bricklaying devices are well known in the patented prior art. The patents to Steed U.S. Pat. No. 2,837,910 and Godwin U.S. Pat. No. 4,122,648, for example, disclose devices for laying bricks in a circular configuration. Similarly, the patents to Daisley U.S. Pat. No. 966,801, Smith U.S. Pat. No. 1,414,755, and Wilnau U.S. Pat. No. 3,881,714 disclose apparatus for building straight block walls.

While the prior bricklaying devices normally operate quite satisfactorily, they are all relatively complex rendering them difficult to assemble and operate. Furthermore, many of the prior devices are of limited versatility by nature of their design, whereby only stacks of bricks of limited size may be formed.

The present invention was developed to overcome these and other disadvantages of the prior bricklaying devices by providing a mechanical bricklayer with which any unskilled person may lay bricks or blocks in a given geometrical configuration with a minimum of prior training.

SUMMARY OF THE INVENTION

Accordingly, it is a primary object of the present invention to provide a device for laying a plurality of successive individual bricks in a given geometrical configuration. The device includes a vertical support and apparatus for positioning a brick in a horizontal plane a given distance from the support. The positioning apparatus includes a brick guide for receiving an individual brick and a connecting arm connected at one end with the brick guide for supporting the guide in the horizontal plane at the given distance from the vertical support. The other end of the connecting arm is connected with the support for movement relative thereto. Upon movement of the positioning means relative to the vertical support, a horizontal layer of successive bricks is formed having a desired geometrical configuration.

According to a more specific embodiment of the invention, the positioning apparatus is vertically displaceable relative to the vertical support so that a plurality of stacked horizontal layers of bricks may be formed into a wall.

It is a further object of the invention to provide an adjustable connecting arm whereby the given distance between a brick to be positioned and the vertical support may be varied.

In one embodiment of the invention, the connecting arm is connected for rotation about the vertical support. Thus, where the support is fixed, the bricks may be positioned into a cylindrical configuration, and where the support is linearly displaceable, the bricks may be positioned into a curved or elliptical configuration.

In an alternative embodiment, the connecting arm is connected with the vertical support for horizontal linear displacement relative thereto, whereby the bricks may be positioned into a linear configuration.

BRIEF DESCRIPTION OF THE DRAWING

Other objects and advantages of the invention will become apparent from a study of the following specification when viewed in the light of the accompanying drawing, in which.

DETAILED DESCRIPTION

Figure 1:
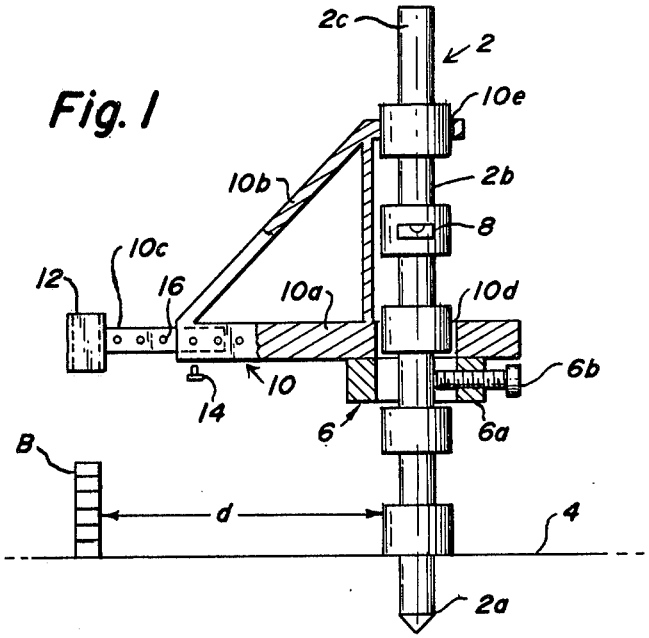
FIG. 1 is a partial sectional view of a device for positioning bricks in a cylindrical configuration.

A first embodiment of the bricklaying device which is suitable for positioning a layer of bricks in a cylindrical configuration will be described with reference to FIG. 1. The device includes a generally cylindrical vertical support 2, the lower end 2*a* of which is adapted to be driven into the ground which comprises a horizontal support surface 4. It is readily apparent that the lower end 2*a* of the support may also be fixed in any conventional manner to a horizontal support surface upon or about which a cylindrical configuration of bricks is to be arranged. The outer surface of the vertical support 2 includes a plurality of notches 2*b* for receiving a locking member 6 as will be developed in greater detail below. The vertical support further includes a pair of level indicating devices 8 which indicate to a user when the support is in its vertical position. A conventional frame (not shown) may be connected with the top portion 2*c* of the vertical support and anchored to the support surface 4 to maintain the support 2 in its vertical position.

A connecting arm 10 is connected with the vertical support for rotation thereabout. The connecting arm includes a main body portion 10*a*, a triangular support portion 10*b*, and an extensible portion 10*c*. The connecting arm main body portion 10*a* includes an aperture 10*d* and the triangular support portion 10*b* includes an aperture 10*e*, the apertures 10*b* and 10*e* both having a diameter slightly greater than the outer diameter of the vertical support 2, whereby the apertures receive the vertical support and the connecting arm 10 is freely rotatable thereabout.

Connected with the free end of the extensible portion 10*c* of the connecting arm is a brick guide member 12 adapted to receive an individual brick B. The brick guide member 12 and the connecting arm 10 cooperate to position a brick in a horizontal plane a given distance d from the vertical support 2. The triangular support portion 10*b* of the connecting arm serves to support the brick guide in the horizontal plane and the extensible portion 10*c* of the connecting arm may be adjusted to change the given distance between the vertical support 2 and the position at which a brick is to be laid. The extensible portion of the connecting arm is secured in a desired incremental position by pin 14 and slot 16 means arranged in the connecting arm. Any one of many suitable adjusting means may be provided for the extensible connecting arm portion 10*c* without changing the inventive concepts of the device.

In operation, the connecting arm 10 is adjusted to define the given distance d. A first brick B is placed in the brick guide 12 and positioned at the given distance from the vertical support. A second brick is then placed in the brick guide and the connecting arm is rotated about the vertical support until the second brick is positioned adjacent the first. In this manner, successive bricks are positioned in a horizontal plane in a cylindrical configuration. If desired, mortar may be placed between adjacent bricks to secure them together.

The brick positioning assembly comprising the connecting arm 10 and the brick guide 12 is vertically displaceable relative to the vertical support 2. Specifically, the locking member 6 is adapted for positioning in a selected one of the notches 2*b* in the outer surface of the support 2. The locking member 6 includes a ring portion 6*a* having an inner diameter slightly greater than the outer diameter of the vertical support and a locking key 6*b* which is adapted for engaging a selected vertical support notch 2*b*. When locked into place, the locking member 6 is adapted to support the connecting arm in a horizontal plane. Preferably, the space between the notches is generally equal to the height of a brick, whereby by vertically adjusting the locking member, successive layers of bricks may be arranged in stacked relation. When mortar is arranged between the stacked bricks, a cylindrical wall may be formed.

The bricklaying device of FIG. 1 may be fabricated from any suitable durable material. The vertical support and locking member are preferably formed of solid iron sections, and the connecting arm and brick guide are preferably formed of a lightweight metal such as aluminum.

While the vertical support 2 of the device of FIG. 1 is shown and described as being fixed relative to the support surface, the support may be linearly displaced in order to form a layer of bricks having a curved or elliptical configuration provided that the support is maintained in a vertical condition.

Figure 2:
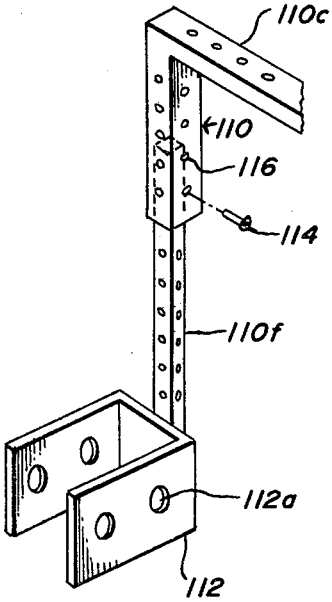
FIG. 2 is a detailed perspective view of the brick guide and connecting arm member.

An alternate construction of the connecting arm 110 is shown in FIG. 2 wherein the connecting arm extensible portion 110*c* is bent downwardly and includes a second extensible portion 110*f* which is vertically adjustable relative to the horizontal support surface. Pin 114 and slot 116 means are provided to secure the second extensible portion in a desired vertical position. The brick guide 112 includes a plurality of apertures 112*a* adapted to receive a user's fingers, whereby the user may support a brick in the brick guide while positioning it relative to a previously laid brick.

Figure 3:
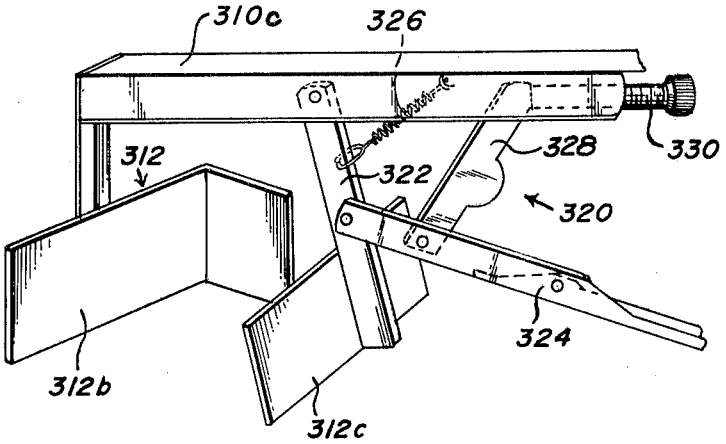
FIGS. 3 and 4 are detailed perspective views of alternative constructions of the brick guide.
Figure 4:
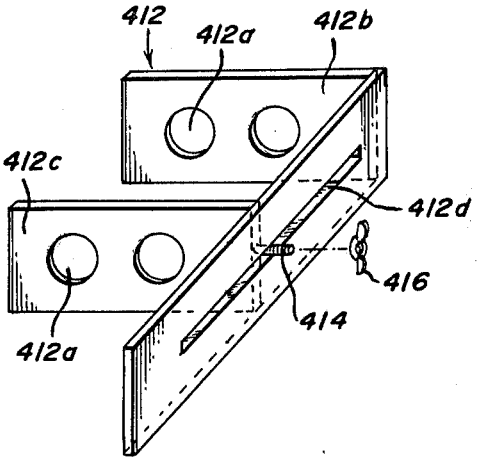

FIGS. 3 and 4 illustrate alternative constructions of an adjustable brick guide for receiving bricks of different dimensions. The adjustable brick guide 312 of FIG. 3 is adapted for securely gripping a brick and includes a fixed portion 312*b* and a movable portion 312*c*. The fixed portion 312*b* is connected with the connecting arm extensible portion 310*c* and the movable portion 312*c* is connected with a vice grip assembly 320. The vice grip assembly includes a pivot arm 322 pivotally connected at one end with the connecting arm extensible portion 310*c* and at the other end with the brick guide movable portion 312*c*. A handle 324 is connected with the pivot arm to operate the grip assembly. A spring 326 is connected between the connecting arm extensible portion 310*c* and the pivot arm 322, and an actuating arm 328 is connected between the connecting arm extensible portion and the handle. Finally, an adjustment screw 330 is mounted on the connecting arm extensible portion for adjusting the position of the actuator arm whereby the brick guide may be adjusted to receive bricks of different sizes.

The adjustable brick guide 412 of FIG. 4 comprises a fixed portion 412*b* and a movable portion 412*c* each of which contain finger receiving apertures 412*a*. The brick guide fixed portion includes a slot 412*d* adapted to receive a threaded spindle 414 secured to one end of the movable brick guide portion 412*c*. A wing nut 416 when tightened on the threaded spindle 414 secures the movable guide in a desired position in accordance with the size of the brick being laid.

Bricklaying devices suitable for positioning a layer of bricks in a linear configuration in a horizontal plane are illustrated in FIGS. 5–8.

Figure 5:
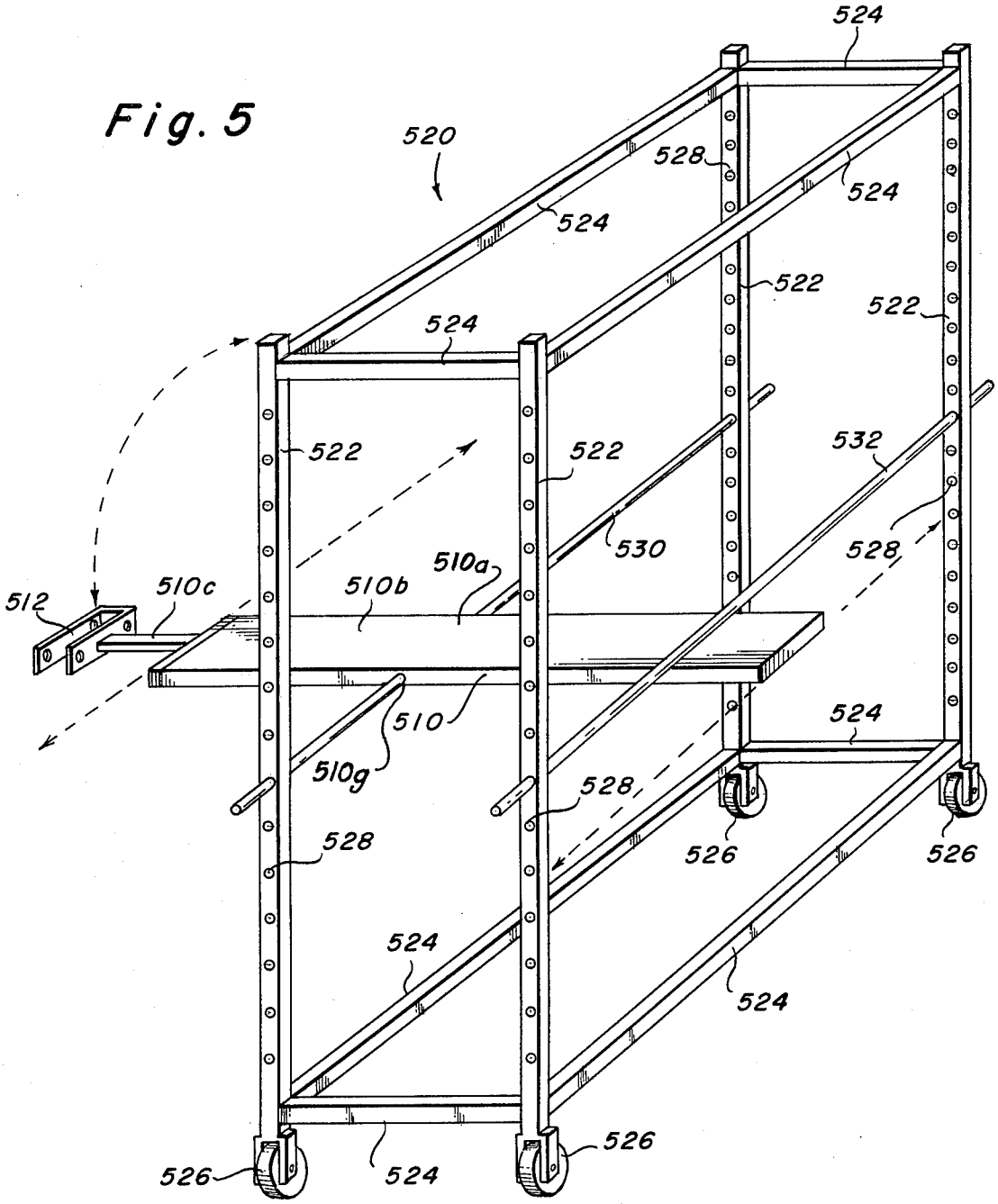
FIG. 5 is a perspective view of a linearly displaceable device for positioning bricks in a linear configuration.

In the device of FIG. 5, the vertical support comprises a stand 520 having vertical leg members 522, horizontal brace members 524, and wheels 526. The leg members 522 include a plurality of apertures 528 adapted to receive horizontal support bars 530, 532. The connecting arm 510 includes a body portion 510*a* and an extensible portion 510*c* which are adjustable in a manner similar to the portions of the connecting arm of the device of FIG. 1. A brick guide 512 is connected with the free end of the connecting arm 510. The connecting arm body portion 510*b* includes a transverse through-bore 510*g* adapted to receive the horizontal support bar 530. The free end of the connecting arm is arranged beneath the horizontal support bar 532, whereby the brick guide is supported in a desired horizontal plane. The connecting arm is linearly displaceable along the horizontal support bars relative to the stand, whereby a layer of successive bricks may be formed in a linear configuration in a horizontal plane. Furthermore, because the stand includes wheels 526, the stand may be displaced in a direction parallel to the direction of the horizontal support bars, whereby a straight linear layer of bricks may be formed of indefinite length. By selectively placing the horizontal support bars 530, 532 in the desired pair of apertures 528, the connecting arm 510 may be vertically displaced relative to the stand, whereby a plurality of stacked horizontal layers of bricks may be formed into a linear wall.

Figure 6:
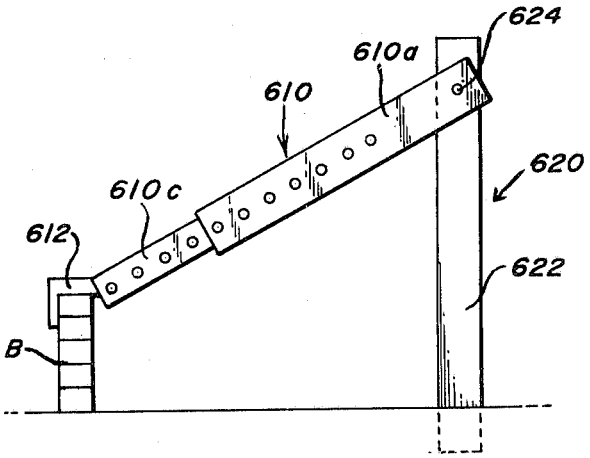
FIGS. 6 and 7 are front and side views, respectively, of a fixed device for laying bricks in a linear configuration.
Figure 7:
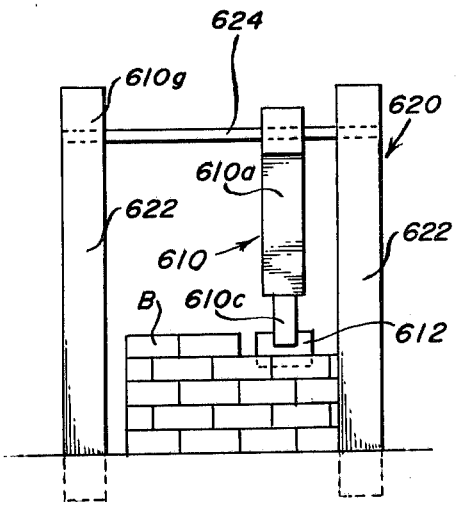

In the device of FIGS. 6 and 7, the vertical support comprises a fixed stand 620 having a pair of leg members 622 and a horizontal cross bar 624 connected therebetween. The connecting arm 610 includes a main body portion 610*a* and an extensible portion 610*c* which are adjusted in the same manner as the connecting arm portions of FIG. 1 to define the given distance d between the support and the position of the brick. In this device, the brick guide 612 is pivotally connected with the free end of the connecting arm extensible portion. The connecting arm main body portion 610*a* includes a transverse through-bore 610*g* adapted to receive the horizontal cross bar 624 of the fixed stand, the connecting arm 610 being linearly displaceable along the length of the cross bar 624. Accordingly, a layer of successive bricks B may be formed in a straight linear configuration in a horizontal plane. Because the connecting arm is pivotally connected with the stand 620 about a horizontal pivot axis, the brick guide is vertically displaceable whereby a plurality of stacked horizontal layers of bricks may be formed into a linear wall.

Figure 8:
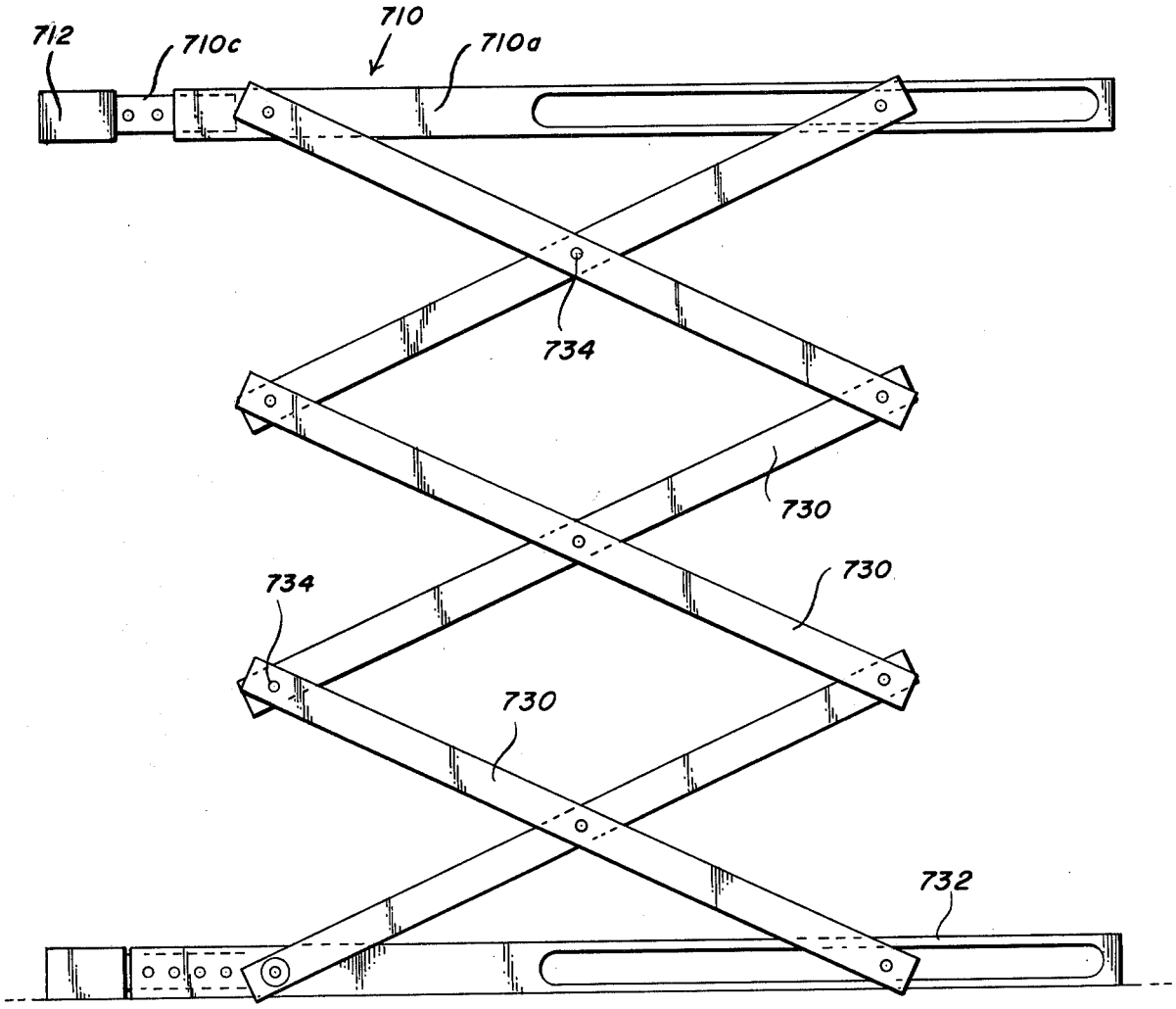
FIG. 8 is a plan view of an alternative construction of a fixed linear bricklaying device.

The bricklaying device of FIG. 8 has a vertical support comprising a scissors configuration of a plurality of leg members 730. The base 732 of the support may be either fixed or linearly displaceable relative to the support surface. At each intersection of the leg members 730 there is provided a horizontal brace bar 734, respectively. At the top of the vertical support, the connecting arm 710 is connected with the uppermost horizontal brace bar. The connecting bar includes a main body portion 710*a* which is arranged parallel with the base member 732 and an extensible portion 710*c* adjustably connected with the main body portion in a manner similar to that as described with respect to the connecting arm of FIG. 1. A brick guide 712 is connected with the free end of the connecting arm extensible arm portion and supported in a horizontal plane a given distance from the vertical support. The connecting arm main body portion includes a transverse throughbore (not shown) adapted to receive the uppermost horizontal brace bar. The connecting arm is linearly displaceable along the length of the horizontal brace bar whereby a horizontal layer of successive bricks may be formed in a linear configuration. By expanding and compressing the scissors configuration of leg members, the connecting arm and brick guide are vertically displaceable relative to the support surface, whereby a plurality of stacked horizontal layers of bricks may be formed into a linear wall.

As in the case of the bricklaying device of FIG. 1, the devices of FIGS. 5–8 may be formed of any suitable durable material such as wood, sheet metal, or the like.

Similarly, the bricklaying devices of FIGS. 1 and 5–8 may be provided with additional connecting arms and guide members, whereby a plurality of users may simultaneously use the device to lay bricks.

While in accordance with the provisions of the Patent Statutes the preferred forms and embodiments of the invention have been illustrated and described, it will be apparent to those skilled in the art that various changes and modifications may be made without deviating from the inventive concepts set forth above.

What is claimed is:

1. Apparatus for successively positioning a plurality of individual bricks in a horizontal plane to form a linear wall, comprising a. first and second horizontal support bars;

b. support means for said first and second horizontal support bars;

c. an elongated connecting arm having a transverse bore therethrough, said first horizontal support bar riding in said transverse bore with said arm being pivotable and linearly displaceable with respect to said first horizontal support bar, said connecting arm disposed beneath said second horizontal support bar such that when said connecting arm abuts said second horizontal support bar said connecting arm is disposed in a substantially horizontal plane; and d. a brick guide adjustably connected to said elongated connecting arm.

2. The apparatus of claim 1 wherein said support means includes means for vertically adjusting the height of said first and second horizontal support bars.

* * * * *